US008148916B2

(12) United States Patent
Nam et al.

(10) Patent No.: US 8,148,916 B2
(45) Date of Patent: Apr. 3, 2012

(54) DRIVING DEVICE OF A LIGHT SOURCE MODULE, LIGHT SOURCE MODULE HAVING THE DRIVING DEVICE, DRIVING METHOD OF THE LIGHT SOURCE MODULE, AND DISPLAY DEVICE HAVING THE DRIVING DEVICE

(75) Inventors: Hyoung-Sik Nam, Incheon (KR); Jee-Hoon Jeon, Hwaseong-si (KR); Kwan-Young Oh, Anyang-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 341 days.

(21) Appl. No.: 12/604,002

(22) Filed: Oct. 22, 2009

(65) Prior Publication Data

US 2010/0110097 A1 May 6, 2010

(51) Int. Cl.
*H05B 37/00* (2006.01)

(52) U.S. Cl. ..... 315/291; 345/102; 345/589; 315/294; 315/224

(58) Field of Classification Search ..... 315/291, 315/297, 294, 169.1–169.4, 317–319, 224; 345/87, 102, 695, 589
See application file for complete search history.

(56) References Cited

U.S. PATENT DOCUMENTS

| | | | | |
|---|---|---|---|---|
| 5,844,540 | A * | 12/1998 | Terasaki | 345/102 |
| 7,839,096 | B2 * | 11/2010 | Kim et al. | 315/291 |
| 8,013,830 | B2 * | 9/2011 | Hsu et al. | 345/102 |
| 2009/0015172 | A1 * | 1/2009 | Huang et al. | 315/246 |
| 2010/0020004 | A1 * | 1/2010 | Smith | 345/102 |
| 2010/0039456 | A1 * | 2/2010 | Um et al. | 345/694 |

FOREIGN PATENT DOCUMENTS

| | | |
|---|---|---|
| JP | 06-222329 | 8/1994 |
| JP | 2006039345 | 2/2006 |
| JP | 2007-140503 | 6/2007 |
| KR | 1020040045079 | 6/2004 |

* cited by examiner

*Primary Examiner* — Douglas W Owens
*Assistant Examiner* — Amy Yang
(74) *Attorney, Agent, or Firm* — F. Chau & Associates, LLC

(57) ABSTRACT

A light source module includes a plurality of light-emitting blocks. A local-dimming driver drives the light-emitting blocks based on a received clock signal (first reference clock) and received dimming levels. The clock signal is input to a liquid crystal display panel and is also input to the local-dimming driver but is delayed within the local-dimming driver by fixed propagation delay. A delay modeling part performs modeling of the fixed propagation delay amount. The clock signal input to the local-dimming driver is first phase-compensated (delayed) by a phase compensation amount to synchronize the driving signals output by the local-dimming driver with the clock signal. The sum of the modeled propagation delay amount and the phase compensation amount is equal to an integral multiple of the period of the clock signal. The driving signal of the light-emitting blocks are synchronized and in phase with the clock signal.

21 Claims, 8 Drawing Sheets

DRIVING DEVICE OF A LIGHT SOURCE MODULE, LIGHT SOURCE MODULE HAVING THE DRIVING DEVICE, DRIVING METHOD OF THE LIGHT SOURCE MODULE, AND DISPLAY DEVICE HAVING THE DRIVING DEVICE

PRIORITY STATEMENT

This application claims priority under 35 U.S.C. §119 to Korean Patent Application No. 2008-109024, filed on Nov. 4, 2008 in the Korean Intellectual Property Office (KIPO), the contents of which are herein incorporated by reference in their entirety.

BACKGROUND OF THE INVENTION

1. Field of the Invention

The present invention relates to a driving device of a light source module, a light source apparatus having the same, a driving method of a light source module, and a display device having the same. More particularly, the present invention relates to a driving device of a light source module capable of enhancing display quality, a light source apparatus having the same, a driving method of a light source module, and a display device having the same.

2. Description of the Related Art

Generally, a liquid crystal display (LCD) includes an LCD panel displaying an image by using the variable light transmittance of liquid crystal and a backlight assembly supplying light behind the LCD panel.

The LCD panel includes an array of pixels formed on an array substrate, each pixel having a thin-film transistor (TFT) electrically connected to a pixel electrode, and a color filter substrate having a common electrode and color filters, and a liquid crystal layer disposed between the array substrate and the color filter substrate.

In each pixel, liquid crystal molecules in the liquid crystal layer are aligned by an electric field formed between the pixel electrode and the common electrode, and the luminance (brightness) of light transmitted through the liquid crystal layer is modulated. As the transmittance of light is increased to a maximum, the LCD pixel displays a white image having a high luminance. As the transmittance of light is decreased to a minimum, the LCD pixel displays a black image having a low luminance.

Recently, local-dimming techniques have been developed in which the backlight assembly is divided into a plurality of separately driven backlight blocks, and the backlight blocks are individually controlled according to the gray scale of an image displayed on the LCD panel. The "local dimming" enables only the required segments of the backlight to be on, making bright image portions in the display appear really bright and dark image portions completely black. This technology allows exceptional contrast ratios as well as energy savings.

The turning on and off of the backlight blocks may affect characteristics light of the TFT of the LCD panel, and cause "waterfall noise".

LCD displays that implement local-dimming techniques typically include a local-dimming driver that includes various circuits such as a power supply and a balancing circuit and a pulse-width modulation (PWM) driving signal generator. The PWM driving signal generator generates the pulse-width modulated lamp driving voltages that control light-amount of each of the plurality of backlight blocks. The balancing part controls load properties of a lamp driving voltage so that it is not to be changed by the temperature or the surrounding environment, and the lamp driving voltage is applied with pulse-width modulation to the light emitters (e.g., light emitting diodes, LEDs) in the light source module. It is desirable to synchronize changes in the light-amount of each of the plurality of backlight blocks in LCD backlight with changes in the displayed picture. Thus, a control signal generator is typically employed to generate a timing signal (a reference clock Cref) that is split and is simultaneously applied to both the LCD panel driver and to the local-dimming driver of the LCD display. However, the reference clock signal Cref must propagate through the power supply and the balancing circuit in the local-dimming driver, and thus the reference clock signal may be delayed by the power supply and/or the balancing part before it is applied to the PWM driving signal generator. Thus, a change in the pulse-width modulated lamp driving voltage output by a PWM driving signal generator may not be simultaneous with a change in gate driving signal controlling the displayed image.

If a lamp driving voltage controlling turning off a backlight block is not synchronized with a gate driving signal of an LCD panel, the phase of the gate driving signal to the LCD panel when the backlight block is turned off may be different from the phase of the lamp driving voltage, and the waterfall noise occurs because of the luminance difference.

A delay locked loop (DLL) can be used to change the phase of a clock signal (a signal with a periodic waveform). Generally, a DLL is a circuit which can be used to match an internal clock of a synchronous memory with an external clock without error. By controlling a time delay of the internal clock relative to the external clock, the internal clock is synchronized with the external clock. From the outside, a DLL can be seen as a negative-delay gate placed in the clock path of a digital circuit. A DLL compares the phase of one of its outputs to the input clock to generate an error signal which is fed back as the control signal to control the delay elements of the DLL. A digital delay locked loop is generally formed of a phase detector which detects the phase difference (error) between a system clock and a feedback clock, and causes adjustment of a time delay circuit in the loop which causes the DLL output clock to be adjusted to lock with the system clock. The time delay is generally formed of a delay line. The main adjustable delay chain composed of many delay gates connected front-to-back. The input of the chain (and thus of the DLL) is connected to the clock that is to be negatively delayed. A multiplexer is connected to each stage of the delay chain; the selector of this multiplexer is automatically updated by a control circuit to produce the negative delay effect. The output of the DLL is the resulting, negatively delayed clock signal. The original analog versions of the Delay Lock Loop were originally patented by Dennis M. Petrich in U.S. Pat. No. 4,338,569. An integrated CMOS digital delay locked loop is disclosed by Combes et als. in "A Portable Clock Multiplier Generator Using Digital CMOS standard cells" published in IEEE Journal of Solid-State Circuits, vol. 30, pages 958-965 (July 1996).

Generally, a delay locked loop DLL does not include a fixed-frequency oscillator, such as a crystal oscillator. Crystal oscillators are piezoelectric quartz crystals that mechanically vibrate between two slightly different shapes. Crystal oscillators are typically used as the frequency reference for phase-locked loops (PLLs), and can be found in nearly every consumer electronic device. Because the crystal is an off-chip component, it adds some cost and complexity to the system design, but the crystal itself is generally quite inexpensive.

SUMMARY ON THE INVENTION

An exemplary embodiment of the present invention provides a local-dimming driving device of a light source module capable of enhancing liquid crystal display (LCD) quality.

According to one aspect of the present invention, a driving device of a light source module includes a delay modeling part, a phase controller and a local-dimming driver.

The delay modeling part performs modeling of the propagation delay amount within the local-dimming driver to facilitate synchronization of its driving signals with a first reference clock. The driving signal output by the local-dimming driver are applied to a light-emitting blocks in a light source module, and the first reference clock is a clock signal of a driving signal applied to a LCD panel. The phase controller sets up a phase compensation amount to make the sum of the propagation delay amount and the phase compensation amount be an integral multiple of the period of the first reference clock, and generates a second reference clock by delaying the phase of the first reference clock by the phase compensation amount. The delay modeling part delays the second reference clock by the modeled propagation delay amount. The local-dimming driver applies a dimming level of each of the light-emitting blocks obtained by analyzing an image data signal from outside, and drives the light-emitting blocks to be synchronized and in-phase with the first reference clock based on the second reference clock and the dimming levels.

According to one aspect of the present invention, the phase controller further comprises a phase comparator for measuring the difference between the phase of the first reference clock and the phase of a third reference clock, the third reference clock being the second reference clock that has been delayed by the modeled propagation delay amount by the delay modeling part, a calculation part resetting the delay compensation amount by summing the phase difference plus the phase compensation amount in a case in which the phase difference exists based on the calculation of phase difference and a delaying part delaying the first reference clock by the reset phase compensation amount.

In some embodiments of the present invention, the delay modeling part may include a resistor and a capacitor.

In some embodiments of the present invention, the light source apparatus includes a generator for generating an oscillation signal having a fixed frequency. The delay modeling part performs modeling of the propagation delay amount by counting a first number corresponding to the propagation delay amount, the first number being the number of periods of the oscillation signal within the propagation delay amount, and the delay modeling part delays the second reference clock by the modeled propagation delay amount.

In some embodiments of the present invention, the light source apparatus includes a generator generating an oscillation signal having a fixed frequency. The delay modeling part performs modeling of the propagation delay amount by counting a first number corresponding to the propagation delay amount, the first number being the number of periods of the oscillation signal within the propagation delay amount, and the delay modeling part delays the phase of the second reference clock by the modeled propagation delay amount.

In some embodiments of the present invention, the light source apparatus includes a generator for generating an oscillation signal having a fixed frequency. The delay modeling part counts the first number corresponding to the propagation delay amount, the first number being the number of periods of the oscillation signal within the propagation delay amount. The phase controller further comprises a calculation part counting a second number corresponding to the period of the first reference clock, the second number being the number of periods of the oscillation signal within the period of the first reference clock, a summing part outputting a third number which is calculated by subtracting the first number from the second number and a delaying part that delays the first reference clock by a phase compensation amount calculated by multiplying the third number by the period of the oscillation signal.

In some embodiments of the present invention, a light source apparatus comprises a light source module including a plurality of light-emitting blocks, a delay modeling part performing modeling of the propagation delay amount through a local-dimming driver to synchronize a driving signal applied to the light-emitting block with a first reference clock which is a clock signal of the driving signal applied to a LCD panel, a phase controller setting up a phase compensation amount to make the sum of the propagation delay amount and the phase compensation amount be an integral multiple of the period of the first reference clock, and generating a second reference clock by delaying the phase of the first reference clock by the phase compensation amount and the local-dimming driver driving the light-emitting block to be synchronized with the first reference clock based on the second reference clock and the dimming levels determined by analyzing an image data signal from outside.

The propagation delay amount may have a fixed value, fixed at time of manufacture of the local-dimming driver, and thus the phase controller automatically controls the phase of the second reference clock based on the modeled propagation delay amount and the frequency of the second reference clock.

According to one aspect of the present invention, a driving method of a light source module comprises determining a dimming level of each light-emitting block in a light source module by analyzing an image data signal from outside, performing modeling of the propagation delay amount through a local-dimming driver, to synchronize a driving signal applied by the local-dimming driver to the light-emitting blocks in phase with a first reference clock which is a clock signal of a driving signal applied to a LCD panel. The method includes delaying the first reference clock by a phase compensation amount to generate a second reference clock input to the local-dimming driver, and controlling the sum of the propagation delay amount and the phase compensation amount being an integral multiple of the period of the first reference clock and driving the light-emitting block in-phase with the first reference clock based on a second reference clock and their dimming levels, the second reference clock being a delayed signal of the first reference clock that has been delayed by the phase compensation amount.

In some embodiments of the present invention, delaying the phase of the first reference clock is performed by resetting the phase compensation amount when the frequency of the first reference clock is changed.

In some embodiments of the present invention, delaying the phase of the first reference clock comprises measuring the difference between the phase of a third reference clock and the phase of the first reference clock, the third reference clock being a delayed clock of the second reference clock that has been delayed by the modeled propagation delay amount, resetting the phase compensation amount based on summing the measured phase difference and the phase compensation amount and delaying the phase of the first reference clock by the reset phase compensation amount.

In some embodiments of the present invention, performing modeling of the propagation delay amount further includes counting a first number being the number of periods of an oscillation signal within the propagation delay amount within a local-dimming driver.

In some embodiments of the present invention, delaying the phase of the first reference clock further comprises counting a second number being the number of periods of the oscillation signal within the period of the first reference clock, outputting a third number which is calculated by subtracting the first number from the second number and delaying the phase of the first reference clock by a phase compensation amount which is calculated by multiplying the third number by the period of the oscillation signal.

In some embodiments of the present invention, a display device comprises a LCD panel displaying an image, and being divided into a plurality of display blocks, a light source module including a plurality of light-emitting blocks and supplying light to the LCD panel, a control signal generator supplying a first reference clock to the LCD panel and to the light source module, a delay modeling part performing modeling of a propagation delay amount to synchronize a driving signal applied by a local-dimming driver to the light-emitting blocks in-phase with a first reference clock, the first reference clock being a clock signal of a driving signal applied to the LCD panel, a phase controller setting up a phase compensation amount to make the sum of the modeled propagation delay amount and the phase compensation amount be an integral multiple of the period of the first reference clock, and generating a second reference clock by delaying the first reference clock by the phase compensation amount and the local-dimming driver driving the light-emitting blocks to be synchronized and in-phase with the first reference clock based on the second reference clock and the dimming levels of each of the light-emitting blocks determined by analyzing an image data signal from outside.

In some embodiments of the present invention, the control signal generator and the phase controller are embodied at the timing controller. The delay modeling part is embodied in the timing controller. The timing controller includes a generator supplying an oscillation signal.

In accordance with embodiments of the present invention, the display quality of a LCD panel may be enhanced by synchronizing the phase of driving signals applied to a light-emitting blocks with a first reference clock which is a clock signal of the driving signal applied to the LCD panel.

BRIEF DESCRIPTION OF THE DRAWINGS

The present invention will be will become more apparent by describing in detailed exemplary embodiments thereof with reference to the accompanying drawings, in which.

DESCRIPTION OF EXEMPLARY EMBODIMENTS OF THE INVENTION

Figure 1:
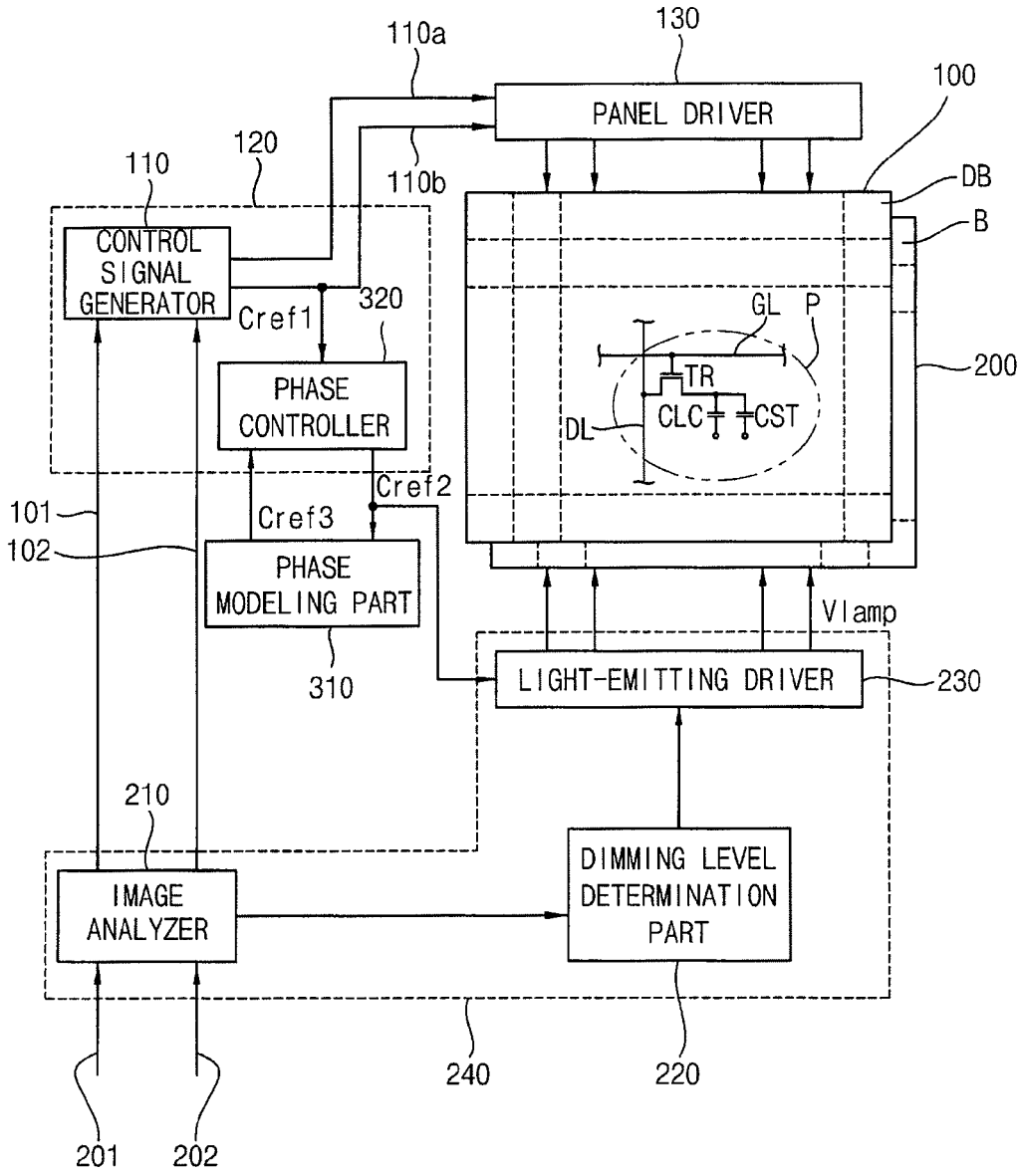
FIG. 1 is a block diagram of a liquid crystal display (LCD) including a light source module according to an exemplary embodiment of the invention.

FIG. 1 is a block diagram of a display device including a light source module according to an exemplary embodiment of the invention. The embodiments of the light source module may be applicable for controlling light sources used in flat panel displays. A liquid crystal display is described hereinafter for purposes of illustrating the embodiments of the present invention.

Referring to FIG. 1, the display device includes an LCD panel 100, a timing controller 120, a LCD panel driver 130, a light source module 200, a local-dimming driver 240 and a delay modeling part 310.

The LCD panel 100 includes a plurality of pixels displaying an image, the number of the pixels is M×N (M and N are natural numbers). Each active pixel P includes a switching element TR connected to a gate line GL and a data line DL, a liquid crystal capacitor $C_{LC}$ and a storage capacitor $C_{ST}$ connected in parallel to the switching element TR. The LCD panel 100 is comprises of a plurality of display blocks DB, and the display blocks may be square or rectangular. The number of the display blocks is m×n (m<M, n<N, m and n are natural numbers. And typically, M is a multiple of m and N is a multiple of n).

The timing controller 120 includes a control signal generator 110 and a phase controller 320.

The control signal generator 110 receives a control signal 101 and an image (data) signal 102 from an external circuit. The control signal generator 110 generates a timing control signal 110*b* for controlling the pixel driving timing of the LCD panel 100 based on the received control signal 101. The timing control signal 110*b* includes a clock signal, a horizontal starting signal and a vertical starting signal. For example, the clock signal includes a first reference clock Cref1 for controlling the pixel driving timing of the LCD panel driver 130 of the LCD panel 100. The first reference clock Cref1 is also split for controlling the local-dimming driver 230 of the light source module 200.

The phase controller 320 generates a second reference clock Cref2 by delaying the first reference clock Cref1. The phase controller 320 delays the first reference clock Cref1 by a phase compensation amount Tdelay corresponding to the period of the first reference clock Cref1 based on the first reference clock Cref1 included in the timing control signal 110*b*. The phase controller 320 provides the delay modeling part 310 with the second reference clock Cref2.

The LCD panel driver 130 drives the LCD panel 100 by using the timing control signal 110*b* and image (data) signal 110*a* provided from the timing controller 120. For example, the LCD panel driver 130 includes a gate driver (that sequentially drives the gate lines FL) and a data driver (that drives the data lines DL). The gate driver generates gate signals provided to the gate lines GL by using the timing control signal, and the data driver generates data signals provided to the data lines DL by using the timing control signal and image (data) signal.

The light source module 200 includes a printed circuit board (PCB) on which a plurality of light-emitting diodes (LEDs) are mounted. The LEDs may include red, green, blue and white LEDs. The light source module 200 is comprised of m×n number of light-emitting blocks B corresponding to the m×n number of display blocks DB. Each of the light-emitting blocks B is positioned to corresponding to one of the display blocks DB. The local-dimming driver 240 includes an image analyzer 210, a dimming level determination part 220 and a local-dimming driver 230.

The image analyzer 210 receives the control signal 201 and image (data) signal 202 received from outside and analyzes the luminance of the received image (data) signal in predetermined units. For example, the image analyzer 210 analyzes a frame unit of the image (data) signal, and acquires a representative image value of each of the display blocks DB corresponding to each of the light-emitting blocks B. Thus, a representative value of each of the light-emitting blocks B is acquired by analyzing the image (data) signal of corresponding display blocks DB.

The dimming level determination part 220 calculates a dimming level controlling the brightness of each light-emitting block B by using the representative value of each of the light-emitting blocks B. For example, the dimming level may be proportional to the representative value. The dimming level determination part 220 calculates m×n dimming levels for each of the plurality of m×n light-emitting blocks B.

The local-dimming driver 230 generates a plurality of m×n driving signals Vlamp to drive the plurality of m×n light-emitting blocks B based upon the m×n dimming levels received from the dimming level determination part 220. The driving signals Vlamp may be pulse-width modulated (PWM) signals. The m×n driving signals Vlamp correspond to the m×n light-emitting blocks B, and thus each of the m×n light-emitting blocks B generate a brightness corresponding to the brightness of the image data of the pixels in each of display blocks DB. The light source module 200 including the local-dimming driver 230 performs a local-dimming method.

The delay modeling part 310 performs modeling of a propagation delay amount Tdmodel used by the delay-locked loop DLL (320, 310) to phase-compensate the signal Cref2 to synchronize the driving signals Vlamp (and the internal driving signal Clamp) with the first reference clock Cref1. The driving signals Vlamp are applied to the light-emitting blocks B, and the first reference clock Cref1 is a clock signal of the driving signal applied to the LCD panel 100. The propagation delay amount Tdmodel to be modeled may be the phase that the second reference clock Cref2 is delayed within the local-dimming driver 240, between the input (Cref1, Cref2) of the power supply 231 and the output (Clamp) of the balancing part 233 (see FIG. 2). The sum of the modeled propagation delay amount Tdmodel plus the phase compensation delay Tdelay1 is an integral multiple of the period of the first reference clock Cref1, achieved by the modeling of the propagation delay amount Tdmodel. In some preferred embodiments, the sum of the modeled propagation delay amount Tdmodel plus the phase compensation delay Tdelay1 is equal to the period (period 1) of the first reference clock Cref1. Thus, Tdelay1 equals period 1 minus Tdmodel, wherein period1 is the period (inverse of the frequency) of Cref1 at frequency f1.

For example, the first reference clock Cref1 having an arbitrary first frequency f1 (f1=1/period1) is applied to the LCD panel 100, and when the blocks B of the light source module 200 are driven by the driving signals Vlamp, the occurrence of waterfall noise is checked for.

When a lamp driving clock Clamp of the driving signals Vlamp output by the local-dimming driver 230 are not synchronized with the first reference clock Cref1, the waterfall noise occurs. Therefore, if the waterfall noise occurs, the delay modeling part 310 performs modeling to create a delay model Tdmodel of the propagation delay amount (of the delay between the input (Cref1, Cref2) of the power supply 231 and the output (Clamp) of the balancing part 233) until the waterfall noise does not occur. Namely, the delay modeling part 310 performs modeling of the propagation delay amount Tdmodel until the lamp driving clock Clamp of the driving signals Vlamp is effectively the same as the first reference clock Cref1.

The delay modeling part 310 may include a resistor (not shown) having resistance R and a capacitor (not shown) having capacitance C. The delay modeling part 310 performs modeling of the propagation delay amount by changing the resistance value R of the resistor and/or the capacitance C of the capacitor until the waterfall noise does not occur.

The propagation delay amount occurs when an arbitrary signal is applied through the local-dimming driver 230, and has a fixed value although signals having a frequency different from each may be applied to the same model.

Therefore, the delay modeling part 310 outputs a third reference clock Cref3 to the phase controller 320. The delay modeling part 310 generates the third reference clock Cref3 by delaying the second reference clock Cref2 by the propagation delay amount. The second reference clock Cref2 is an input signal of the delay modeling part 310 and of the local-dimming driver 230. Thus, the delay modeling part 310 makes the phase controller 320 compensate the third reference clock Cref3 by the phase compensation amount Tdelay. The third reference clock Cref3 input to the phase controller 320 may have the same phase as the second reference clock Cref2 applied to the delay modeling part 310.

The phase controller 320 controls the phase compensation amount Tdelay to make the sum of the propagation delay amount and the phase compensation amount Tdelay equal to the period (period1) of the first reference clock Cref1. Therefore, the first reference clock Cref1 input to the phase controller 320 is delayed by the phase compensation amount Tdelay, and is output as the second reference clock Cref2. The second reference clock Cref2 is delayed by the phase compensation amount Tdelay by the phase controller 320, so that a lamp driving clock Clamp having the same phase as the first reference clock Cref1 is applied within the local-dimming driver 230.

When the second reference clock Cref2 is supplied to the local-dimming driver 230, the local-dimming driver 230 generates the driving signals Vlamp synchronized to the first reference clock Cref1 and to the lamp driving clock Clamp. The second reference clock Cref2 is delayed by a fixed delay quantity by the power supply 231 and the balancing part 233 in the local-dimming driver 230, and the delay modeling part 310 performs modeling of that delay to synchronize the driving signals Vlamp with the first reference clock Cref1. This phase of the second reference clock Cref2 that is delayed by the fixed delay quantity by the local-dimming driver 230 is changed so that the lamp driving clock Clamp will be synchronized and in-phase with the first reference clock Cref1.

The phase controller 320 creates the delay (phase compensation amount Tdelay) of the second reference clock Cref2 relative to the first reference clock Cref1 and supplies the delayed first reference clock Cref1 (Cref2) to the local-dimming driver 230 to synchronize the driving signals Vlamp with the first reference clock Cref1. The phase controller 320 delays the first reference clock Cref1 by the phase compensation amount Tdelay.

The frequency of the first reference clock Cref1 may be externally changed. If the frequency of the first reference clock Cref1 changes, the phase controller 320 resets the phase compensation amount Tdelay to correspond to the changed (new) frequency f2 (f2=1/period2) of the first reference clock Cref1. The phase compensation amount Tdelay may be reset by subtracting the modeled propagation delay amount Tdmodel having the fixed quantity from the period (period 2) of Cref12 (the changed first reference clock Cref1).

Therefore, the changed first reference clock Cref12 delayed by the reset phase compensation amount Tdelay2 becomes the second reference clock Cref2. The second reference clock Cref2 is applied to the input of local-dimming driver 230, and is delayed by the propagation delay amount having a fixed quantity within the local-dimming driver 230, and yet the driving signal Vlamp is output synchronized and in-phase with the first reference clock Cref1.

Figure 2:
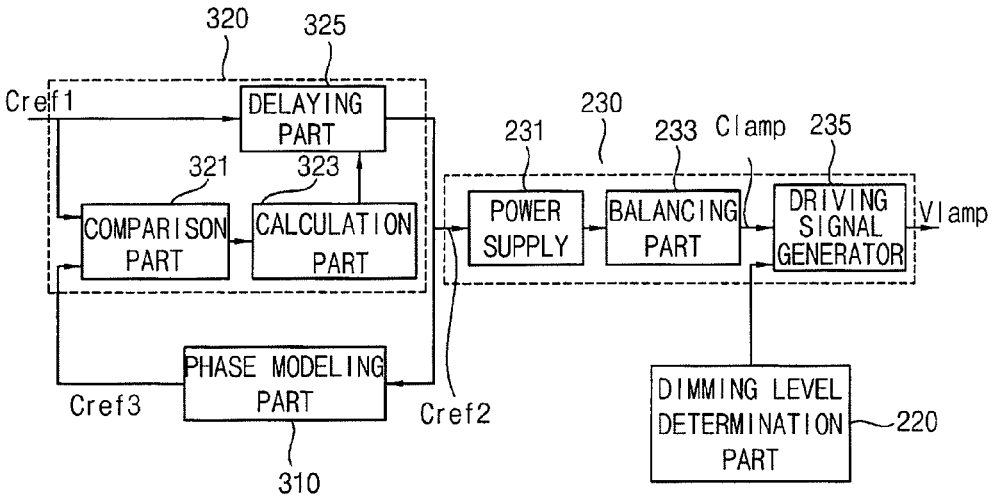
FIG. 2 is a block diagram of the phase controller 320, the delay modeling part 310, the dimming level determination part 220 and the local-dimming driver 230 in FIG. 1.
Figure 3A:
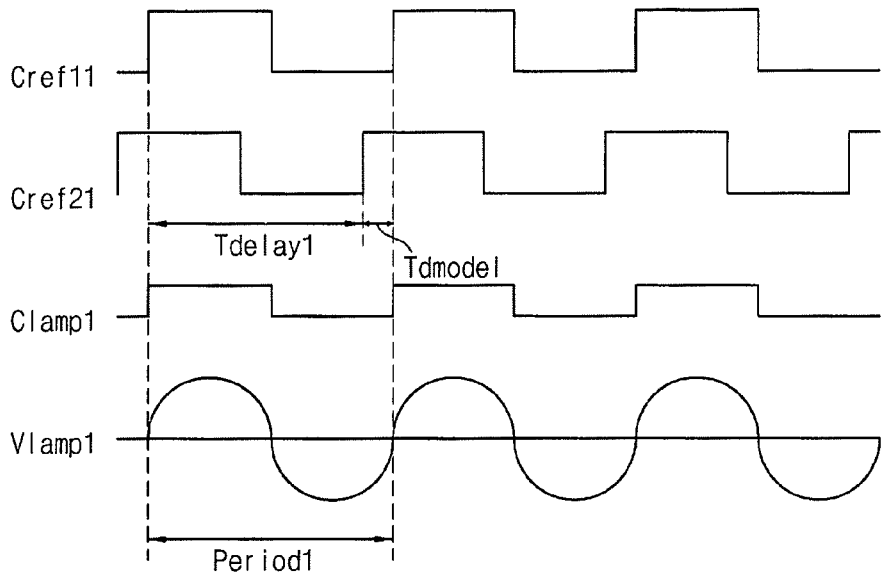
FIGS. 3A and 3B are timing diagrams illustrating input and output signals of the phase controller 320, the delay modeling part 310, and the local-dimming driver 230 in FIG. 2.
Figure 3B:
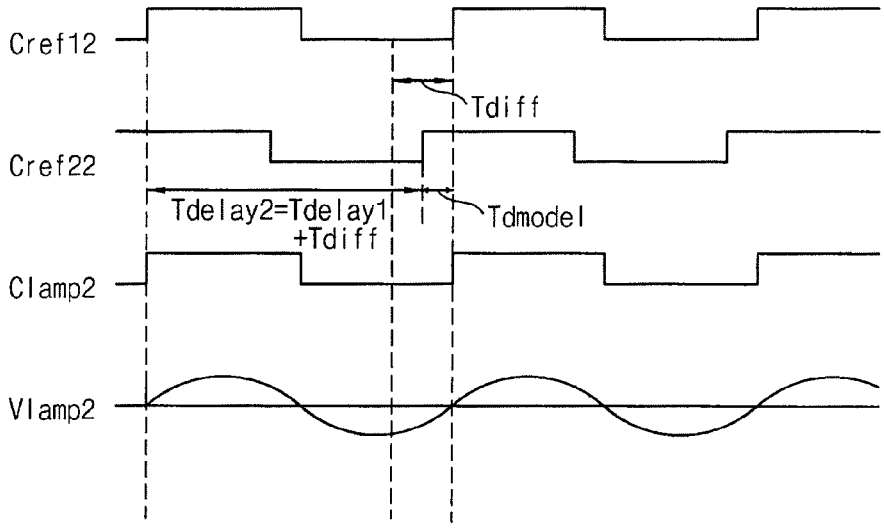

FIG. 2 is a block diagram illustrating the phase controller 320, the delay modeling part 310, the dimming level determination part 220 and the local-dimming driver 230 in FIG. 1. FIGS. 3A and 3B are timing diagrams illustrating input and output signals of the phase controller 320, the delay modeling part 310, and the local-dimming driver 230 in FIG. 2.

Referring to FIGS. 2, 3A and 3B, the first reference clock Cref1 while having a first frequency f1 (f1=1/period1) is referred to as Cref11, and the changed first reference clock having a second frequency f2 (f2=1/period2) is referred to as Cref12. The first reference clock Cref1 and the second reference clock Cref2 always have the same period (same frequency).

The second reference clock Cref2 corresponds to the first reference clock Cref11 delayed by the phase compensation amount Tdelay (e.g., Tdelay1). The second reference clock Cref2 while having the first frequency f1 (f1=1/period1) is referred to as Cref21. The second reference clock Cref2 while having the second frequency f2 (f2=1/period2) is referred to as Cref22. The lamp driving clock (Clamp) while having the first frequency f1 is referred to as Clamp1. The driving signal Vlamp while having the first frequency f1 is referred to as Vlamp1.

The change of the waveform (phase change due to delay) of first reference clock Cref1 input to the phase controller 320, as it is output as Cref2 to the delay modeling part 310 and to the local-dimming driver 230 is shown in FIGS. 3A and 3B.

Referring to FIG. 2, the local-dimming driver 230 includes a power supply 231, a balancing part 233 and a driving signal generator 235. The power supply 231 with the balancing part 233 supplies a driving voltage to the driving signal generator 235. The balancing part 233 controls load properties of a voltage so that it is not changed by the temperature or a surrounding environment, and the voltage is applied to light sources of the light source module 200 by the driving signal generator 235. The driving signal generator 235 generates the driving signals Vlamp (Vlamp1) controlling the light-amount of each of the m×n backlight blocks B by using the dimming levels calculated by the dimming level determination part 220.

The driving signal generator 235 may select an image mode, and generate the driving signal Vlamp (Vlamp1) having a frequency corresponding to the selected image mode.

The second reference clock Cref2 (Cref21 at frequency f1) supplied from the phase controller 320 is delayed by the power supply 231 and by the balancing part 233, as signal Clamp2 input to the driving signal generator 235. The delayed second reference clock Cref2 (Cref21) output by the balancing part 233 as Clamp2 is a synchronized and in-phase with the first reference clock Cref1 (Cref11).

The phase controller 320 includes a phase comparator 321, a calculation part 323 and a delaying part 325.

The second reference clock Cref2 is delayed by the delay modeling part 310 by the modeled propagation delay amount Tdmodel, and the phase comparator 321 calculates a difference between the phase of the third reference clock Cref3 (which is the second reference clock Cref2 delayed by the modeled propagation delay amount Tdmodel) and the phase of the first reference clock Cref1. The calculation part 323 resets the phase compensation amount Tdelay2 by adding the phase difference Tdiff to the phase compensation amount Tdelay1. Tdiff may be a positive or negative value.

The delaying part 325 delays the first reference clock Cref1 by the reset phase compensation amount Tdelay2, and generates the second reference clock Cref2 (Cref21).

The second reference clock Cref2 (Cref21) is applied to the delay modeling part 310 and to the light source module 230. The second reference clock Cref2 (Cref21) is input to the light source module 230, and is synchronized with (but not in phase) with the driving signal Vlamp (Vlamp1).

When the delay modeling part 310 performs modeling of the propagation delay amount Tdmodel, the calculation part 323 controls the phase compensation amount Tdelay. The delay modeling part 310 models the phase delaying amount Tdmodel until the waterfall noise does not occur, and the delaying part 325 delays the first reference clock Cref1 (Cref11) by the phase compensation amount Tdelay1 calculated by the calculation part 323, and generates the second reference clock Cref2 (Cref21).

If the phase modeling is complete, the phase comparator 321 calculates the phase difference (error) between the phase of the third reference clock Cref3 and the phase of the first reference clock Cref1 (Cref11) and the calculated phase difference is zero. The delaying part 325 delays the first reference clock Cref1 (Cref11) by the phase compensation amount Tdelay (Tdelay1), and supplies the phase-compensated second reference clock Cref2 (Cref21) to the local-dimming driver 230.

The phase compensation amount Tdelay may be changed (e.g., from Tdelay1 to Tdelay2) upon a change of the frequency of the first reference clock Cref1 (from frequency f1 to frequency f2).

The phase controller 320 calculates the new phase compensation amount Tdelay2 corresponding to the first reference clock Cref12 (Cref1 having a second frequency f2) by subtracting the fixed propagation delay amount Tdmodel having a known quantity from the new period (period2) of the first reference clock Cref12 having the second frequency f2. Thus, Tdelay2 equals period2 minus Tdmodel, wherein period2 is the period (inverse of the frequency) of Cref1 at new frequency f2.

The second reference clock Cref2 (Cref21) having the first frequency f1 is applied to the delay modeling part 310, and the delay modeling part 310 delays the second reference clock Cref2 (Cref21) by the modeled propagation delay amount Tdmodel, and supplies the third reference clock Cref3 to the phase comparator 321. The third reference clock Cref3 is expected to have the same phase as the first reference clock Cref1 (Cref11) has the first frequency f1.

The phase comparator 321 compares the phase of the third reference clock Cref3 having the second frequency f2 with the phase of the first reference Cref1 (Cref12) having the second frequency 2. The phase difference between the phase of the third reference clock Cref3 and the phase of the first reference clock Cref12 is an "error" signal.

The calculation part 323 calculates the phase delaying amount Tdelay2 corresponding to the second frequency by adding up the phase difference Tdiff and the phase delaying amount Tdelay1 corresponding to the first frequency. Thus, Tdelay2 equals Tdelay1 plus Tdiff.

If the frequency of the first reference clock Cref12 is changed, the calculation part 323 resets the phase compensation amount Tdelay1 by subtracting the phase delaying amount Tdmodel from the new period of the first reference clock Cref12.

The second reference clock Cref2 (Cref22) delayed by the reset phase compensation amount Tdelay2 is applied to the delay modeling part 310 and to the local-dimming driver 230.

The second reference clock Cref2 (Cref22) applied to the delay modeling part 310 is controlled corresponding to the change of the first reference clock Cref1.

The second reference clock Cref2 (Cref22) applied to the local-dimming driver 230 propagates through the local-dimming driver 230, and synchronizes the driving signals Vlamp (Vlamp2). As the second reference clock Cref2 (Cref22) delayed by the reset phase compensation amount Tdelay2 is delayed by the phase delaying amount Tdmodel at the local-dimming driver 230, the driving signal Vlamp2 output by the local-dimming driver 230 is synchronized with the lamp driving clock Clamp2 which has the same phase as the first reference clock Cref1 (Cref12).

Figure 4:
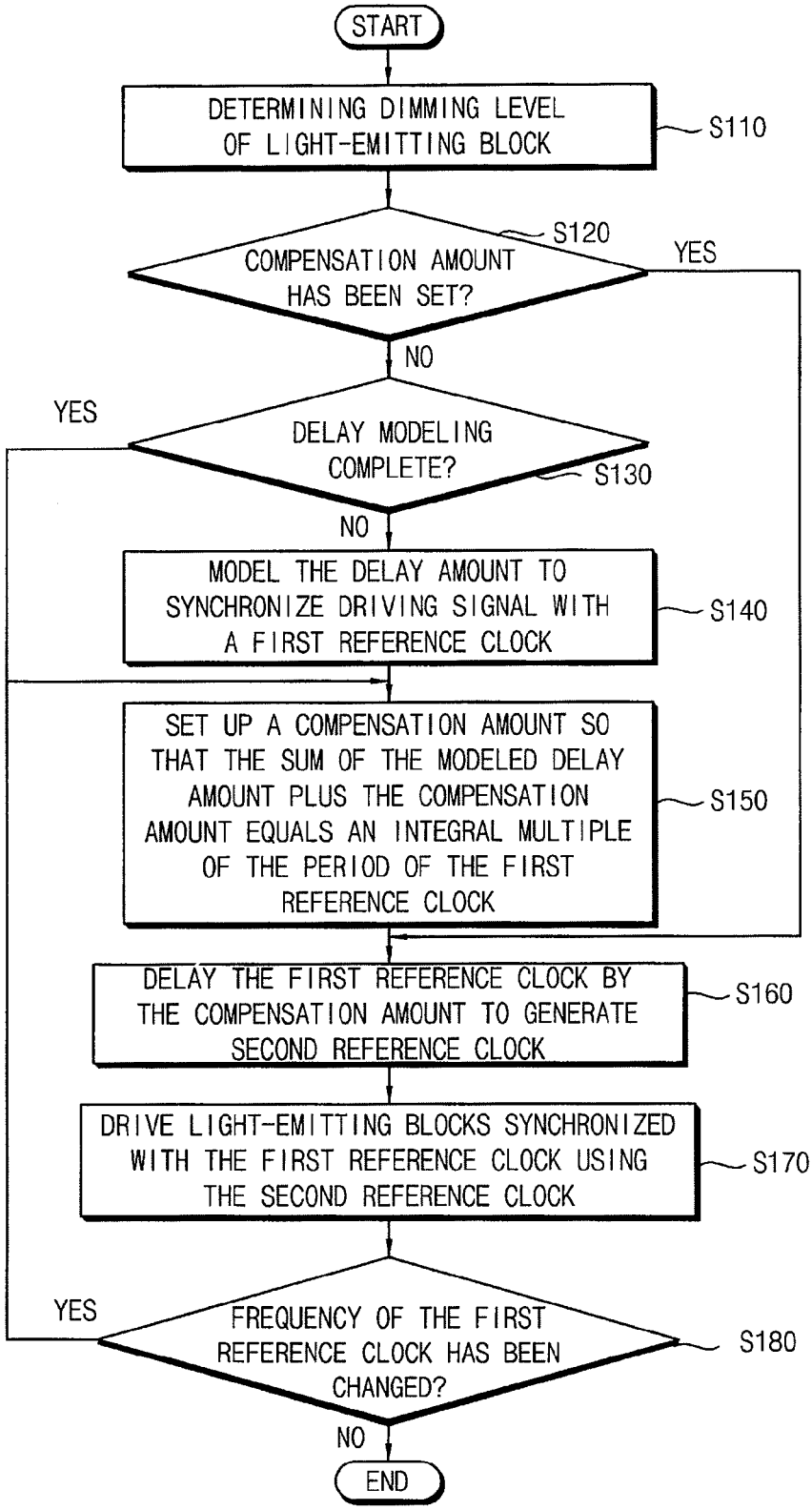
FIG. 4 is a flowchart of a driving method of the light source module in FIG. 1.

FIG. 4 is a flowchart illustrating a driving method of a light source module 200 in FIG. 1.

Referring to FIGS. 1, 2, 3A, 3B and 4, a dimming level of each of the m×n light-emitting blocks B is determined by analyzing the image (data) signal (step S110). The dimming level determination part 220 determines the dimming level of each light-emitting block B and controls the brightness of the light-emitting block B based on representative brightness value of each of the corresponding display blocks DB. For example, the dimming level of a light-emitting blocks B is proportional to the representative brightness value of its corresponding display block DB.

Meanwhile, the phase compensation amount Tdelay is continuously checked (error minimized) and set up by the phase controller 320 (step S120).

If the phase compensation amount Tdelay is not set up, the delay modeling part 310 determines whether the modeling of the propagation delay amount Tdmodel is complete (step S130). The modeling of the propagation delay amount Tmodel is complete when the waterfall noise does not occur. The waterfall noise and its absence can be detected electronically or visually. The waterfall noise or its absence can be detected electronically by comparing the phase at Cref1 to the phase of Clamp. The waterfall noise or its absence can be detected electronically by a human operator, for example a manufacturer while a "test pattern" video with alternating dark and light is being displayed, or by optical/electronic sensors, for example while a "test pattern" video is being displayed. Because the propagation delay amount within the local-dimming driver 230 is typically fixed and permanent once components 231 and 233 for the display are selected and assembled, some embodiments of the invention may be practiced by a manufacturer who calculates the propagation delay amount and fixes Tmodel before consumer use. In alternative embodiments, the light-emitting part 230 can be modified to allow the internal signal Clamp to be made accessible for use as signal Cref3 of the delay-locked loop DLL (Clamp or a buffered/filtered Clamp becomes the input Cref3 to the phase controller 320), and thus the delay modeling circuit 310 may be omitted.

If the modeling of the propagation delay amount Tdmodel is not complete, the delay modeling part 310 performs modeling of the propagation delay amount Tdmodel (step S140), and the phase controller 320 automatically sets up the phase compensation amount Tdelay (step S150).

The first reference clock Cref1 is continuously delayed by the phase compensation amount Tdelay (step S160), the second reference clock Cref1 is thereby generated, the light-emitting blocks B are driven synchronized and in-phase with the first reference clock Cref1 based on the phase-compensated second reference clock Cref1 (step S170).

If the modeling of the propagation delay amount Tdmodel is complete, the delay modeling part 310 does not repeat modeling of the propagation delay amount Tdmodel, and returns to step S150. If the phase compensation amount Tdelay is set up in step S120, step S160 is performed again, continuously. Finally, a change of the frequency of the first reference clock Cref1 is continuously checked. (step S180) If the frequency of the first reference clock Cref1 is changed, step S150 is performed again.

Figure 5:
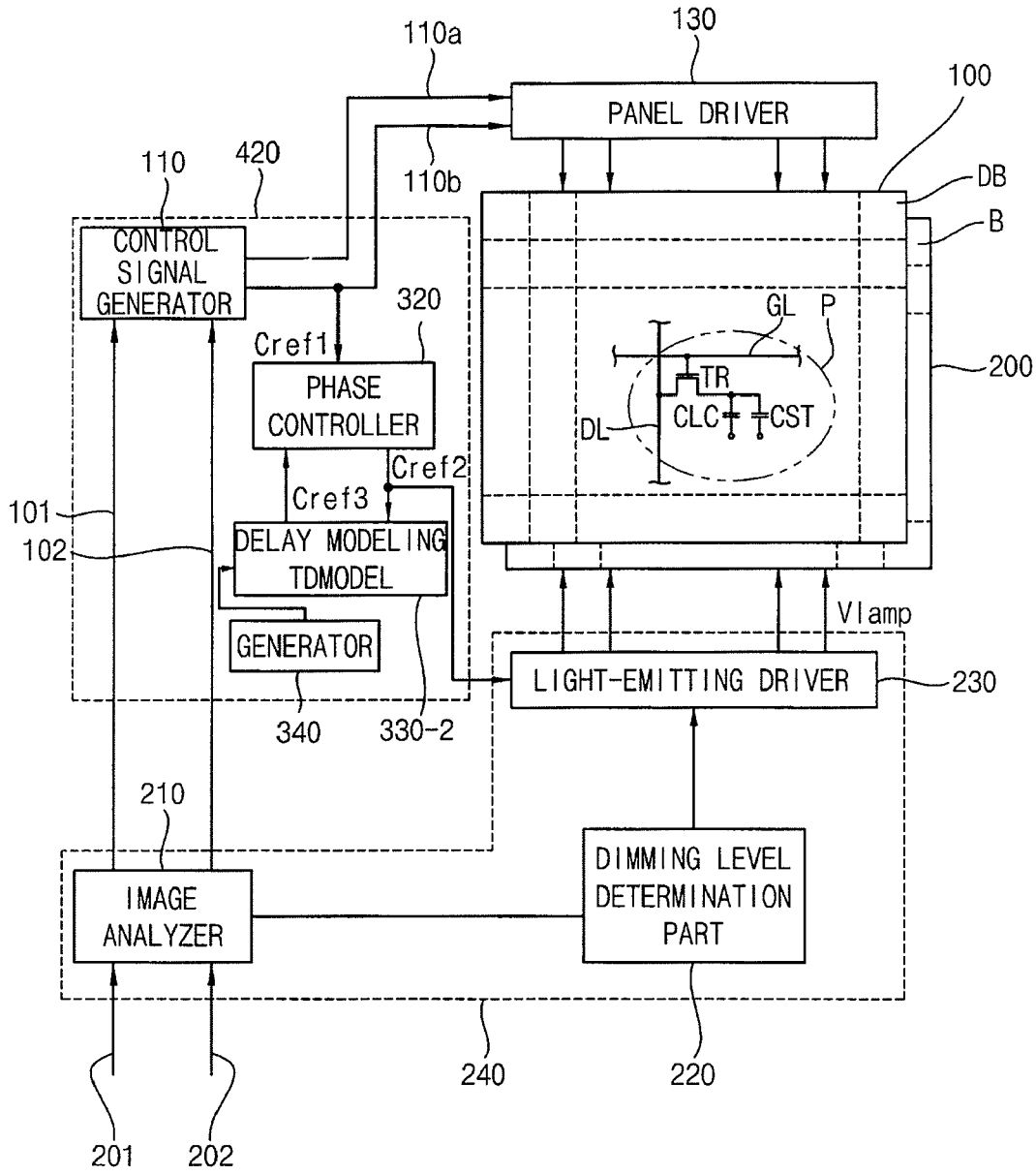
FIG. 5 is a block diagram of a liquid crystal display (LCD) including a light source module according to another exemplary embodiment of the invention.
Figure 6:
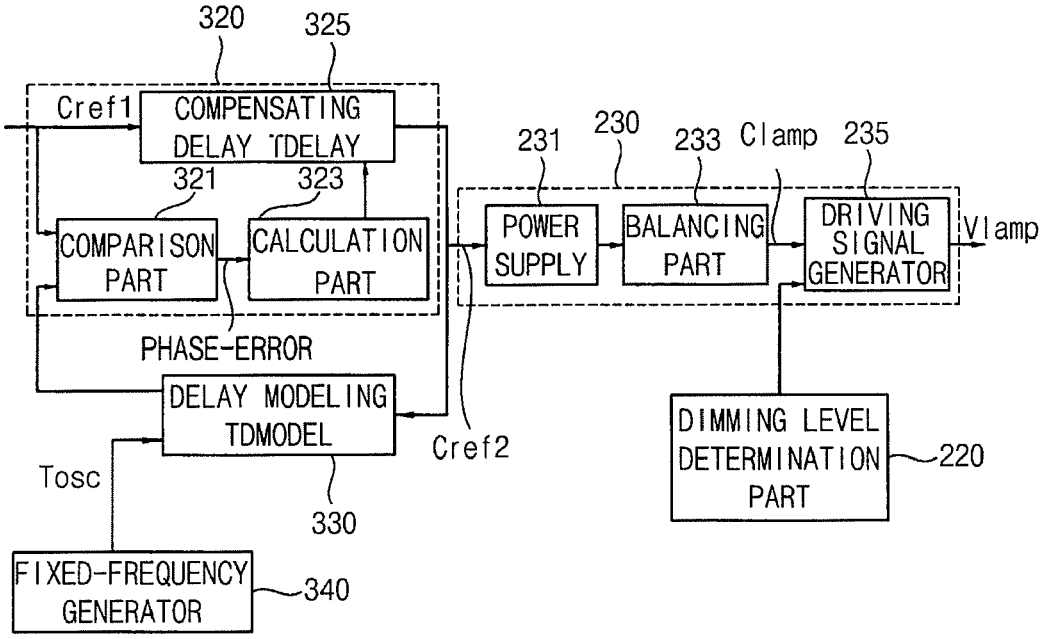
FIG. 6 is a block diagram of the phase controller 310, the delay modeling part 330-2, the dimming level determination part 220 and the local-dimming driver 230 in FIG. 5.

FIG. 5 is a block diagram of a liquid crystal display device (LCD) including a light source module according to another exemplary embodiment of the invention. FIG. 6 is a block diagram of the phase controller 310, the delay modeling part 330-2, the dimming level determination part 220 and the local-dimming driver 230 in FIG. 5.

The display device in FIG. 5 is substantially the same as the display device described with reference to FIG. 1 except that a timing controller 420 includes a delay modeling part 330-2 receiving a fixed frequency (1/Tosc), and a fixed-frequency generator 340. Thus, the same reference numerals are used for the same elements and the repeated descriptions will be omitted.

The timing of input and output signals of the phase controller 310, the delay modeling part 330-2, and the local-dimming driver 230 described with reference to FIG. 6 is substantially the same as the timing described with reference to timing diagrams FIGS. 3A and 3B. The local-dimming driving method of the light source module 200 described with reference to FIG. 5 is the same as the driving method of the light source module described with reference to FIG. 4.

Referring to FIGS. 3A, 3B, 5 and 6, the second reference clock Cref2 is applied to the delay modeling part 330-2; a fixed-frequency oscillation signal having period Tosc from the fixed-frequency generator 340 is applied to the delay modeling part 330-2. The delay modeling part 330-2 checks whether the modeling propagation delay amount Tdmodel is a multiple k of a cycle Tosc (period) of the oscillation signal, and performs modeling of the propagation delay amount (Tdmodel=k×Tosc. Here, the multiple k, of the period Tosc, is referred to as a first number (k).

For example, the delay modeling part 330-2 performs modeling of the propagation delay amount Tdmodel by altering the first number k until the waterfall noise dose not occur.

If the frequency of the first reference clock Cref1 is changed, the phase controller 320 resets the phase compensation amount Tdelay from Tdelay1 to Tdelay2 corresponding to the changed first reference clock Cref1, e.g., by subtracting the propagation delay amount Tdmodel having the fixed quantity from the new period period2 of the changed first reference clock Cref1 (Cref12).

Therefore, the first reference clock Cref1 delayed by the reset phase compensation amount Tdelay2 is the phase-compensated second reference clock Cref2, the second reference clock Cref2 is applied to the local-dimming driver 230, and delayed inside the local-dimming driver 230 by the propagation delay amount having a fixed quantity. Thus, the local-dimming driver 230 outputs the driving signal Vlamp synchronized to and in-phase with the first reference clock Cref1.

The light source apparatus according to this exemplary embodiment of the invention may use the fixed-frequency generator 340 existing in the timing controller 420, in order to efficiently implement the delay modeling part 330-2.

Figure 7:
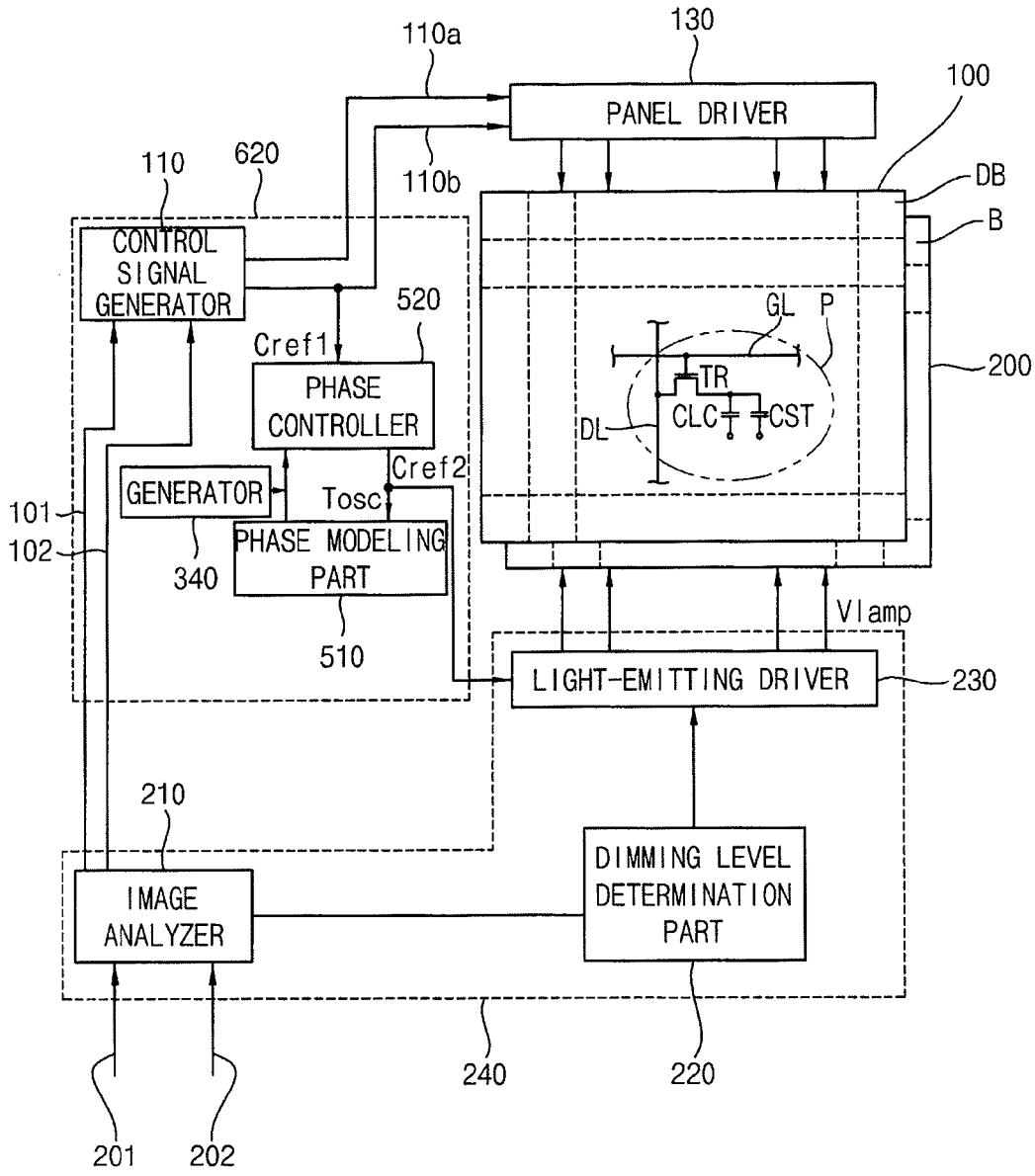
FIG. 7 is a block diagram of a of a liquid crystal display (LCD) including a light source module according to still another exemplary embodiment of the invention.
Figure 8:
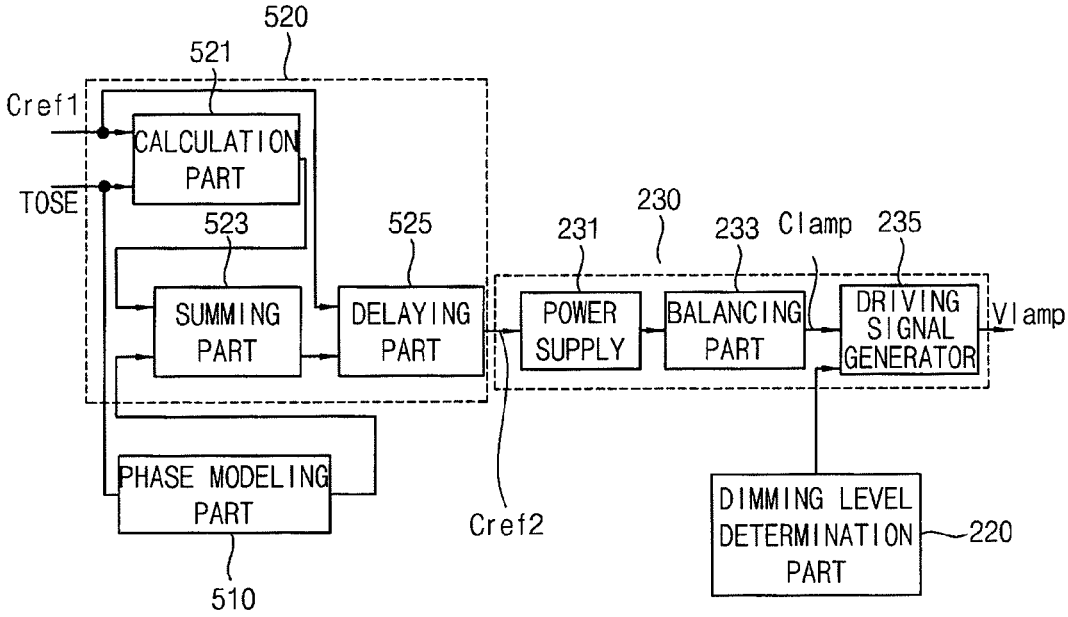
FIG. 8 is a block diagram of the phase controller 520, the delay modeling part 510, the dimming level determination part 220 and the local-dimming driver 230 in FIG. 7.

FIG. 7 is a block diagram of a of a liquid crystal display (LCD) including a light source module according to another exemplary embodiment of the invention. FIG. 8 is a block diagram of the phase controller 520, a delay modeling part 510, a dimming level determination part 220 and a local-dimming driver 230 in FIG. 7.

The display device in FIG. 7 is substantially the same as the display device described with reference to FIG. 1 except that a timing controller 620 includes a delay modeling part 510 and a fixed-frequency generator 340, and includes a phase controller 520 instead of the phase controller 320. Thus, the same reference numerals are used for the same elements and the repeated descriptions will be omitted.

The timing of input and output signals of the phase controller 520, the delay modeling part 510, and the local-dimming driver 230 described with reference to FIG. 8 is substantially the same as the timing described with reference to timing diagrams FIGS. 3A and 3B. A driving method of the light source module 100 described with reference to FIG. 7 is the same as the driving method of the light source module 100 described with reference to FIG. 4.

Referring to FIGS. 7 and 8, the oscillation signal Tosc from the fixed-frequency generator 340 is applied to the delay modeling part 510 and to the calculation part 521. The delay modeling part 510 determines that the propagation delay amount Tdmodel is a multiple k1 of the cycle (period) Tosc of the oscillation signal. Here, the multiple k1, of the cycle (period) Tosc, is referred to as a first number.

For example, the delay modeling part 330 performs modeling Tdmodel of the propagation delay amount by altering the first number k1 until the waterfall noise dose not occur. The first number k1 corresponding to the propagation delay amount is output at the delay modeling part 510.

If the frequency of the first reference clock Cref1 is changed, the phase controller 520 may reset the phase compensation amount Tdelay to correspond to the changed first reference clock Cref12 by subtracting the propagation delay amount Tdmodel having the fixed quantity from the period (period2) of the changed first reference clock Cref1 Cref12.

Therefore, the first reference clock Cref1 delayed by the reset phase compensation amount Tdelay2 is the phase-compensated second reference clock Cref2, the second reference clock Cref2 is applied to the local-dimming driver 230, and delayed inside the local-dimming driver 230 by the propagation delay amount having a fixed quantity. Thus, the local-dimming driver 230 outputs the driving signal Vlamp synchronized to and in-phase with the first reference clock Cref1.

The second reference clock Cref2 supplied from the phase controller 520 is delayed by the power supply 231 and the balancing part 233, and the delayed second reference clock Cref2 (Clamp) is applied to the driving signal generator 235. At this time, the delayed second reference clock Cref2 (Clamp) is synchronized with the first reference clock Cref1.

The phase controller 520 includes a calculation part 521, a summing part 523 and a delaying part 525.

Referring to FIGS. 3A, 3B, 7 and 8, the fixed-frequency oscillation signal Tosc and the first reference clock Cref11 (Cref1 at the first frequency f1) are applied to the calculation part 521. The calculation part 521 calculates that the period (period1) of the first reference clock Cref11 is a certain multiple k2 of the cycle (period) Tosc of the oscillation signal. Here, the multiple k2, of the period Tosc of the oscillation signal, is referred to as a second number.

The summing part 523 outputs a third number, (k2–k1) indicating a phase-control signal, which is calculated by subtracting the first number k1 from the checked second number k2.

The delay part 525 delays the first reference clock Cref11 by an amount equal to multiplying phase-control signal (the third number) by the cycle (period) Tosc of the oscillation signal, and thereby generates the second reference clock Cref21.

The phase-compensated second reference clock Cref21 is applied to the light source module 230.

The second reference clock Cref21 applied to the light source module 230 propagates through the light source module 230, the driving signals (Vlamp1) are output synchronized and in-phase with Cref1.

When the delay modeling part 510 performs modeling of the propagation delay amount, the summing part 523 controls the third number. The delay modeling part 510 performs modeling of the propagation delay amount until the waterfall noise does not occur, and outputs the first number k1.

The third number is derived by subtracting the first number k1 fixed at the summing part 523 from the second number k2, and the phase compensation amount Tdelay is derived by multiplying the third number by the cycle (period) Tosc of the oscillation signal. The delay part 525 delays the first reference clock Cref11 by the phase compensation amount Tdelay which is derived by multiplying the third number by the cycle (period) Tosc of the oscillation signal, and generates the phase-compensated second reference clock Cref21.

If delay modeling is complete, the third number which is output by the summing part 523 has a constant value (while the frequency remains unchanged). Therefore, the delay part 525 delays the first reference clock Cref11 by the phase compensation amount Tdelay1, and supplies the second reference clock Cref21 with the local-dimming driver 230.

If the frequency of the first reference clock Cref11 is changed, the second number k2 changes, and the phase compensation amount Tdelay1 may be changed to Tdelay2.

The phase controller 520 derives the third number corresponding to the first reference clock Cref12 by subtracting the first number k1 having a fixed value from the second number k2 corresponding to first reference clock Cref12 having the second frequency f2.

The delay part 525 recalculates the new phase compensation amount Tdelay2 by multiplying the third number by the cycle (period) Tosc of the oscillation signal.

Tdiff described with reference to FIG. 3B of the embodiment is calculated by multiplying the cycle (period) Tosc of the oscillation signal by the difference between the second number k2-1 corresponding to the first frequency f1 and the second number k2-2 corresponding to the second frequency 2.

The summing part 523 may calculate the new phase compensation delay amount Tdelay2 corresponding to the second frequency f2 by summing the phase difference Tdiff and the phase compensation delay amount Tdelay1 corresponding to the first frequency f1.

Because the frequency of the first reference clock Cref12 is changed, the delay part 525 resets the phase compensation amount Tdelay1 into the phase compensation amount Tdelay2 by subtracting the modeled propagation delay amount Tdmodel from the period (period2) of the first reference clock Cref12.

The second reference clock Cref22 delayed by the reset phase compensation amount Tdelay2 is applied to the local-dimming driver 230.

The second reference clock Cref22 applied to the light source module 230 propagates through the light source module 230, and the driving signals Vlamp2 are output synchronized and in-phase with Cref1. At this time, the phase-compensated second reference clock Cref22 delayed by the reset phase compensation amount Tdelay2 is delayed by the modeled propagation delay amount Tdmodel within the local-dimming driver 23. Thus the driving signals Vlamp2 output by the local-dimming driver 230 are in-phase with the lamp driving clock Clamp2 having the same phase as the first reference clock Cref12.

The light source apparatus according to this exemplary embodiment may use the fixed-frequency generator 340 provided in the timing controller 620, in order to efficiently implement the delay modeling part 510 and the phase controller 520. Also, because an output signal of the phase controller 520 is not applied to the delay modeling part 510, a simpler circuit implementation may be possible.

According to exemplary embodiments of the present invention, a driving signal Vlamp applied to a light-emitting block is synchronized and in-phase with a first reference clock Cref1 by modeling of the propagation delay amount within a local-dimming driver 230, and the first reference clock Cref1 is a clock signal of the driving signal applied to the LCD panel.

Therefore, waterfall noise may be removed in a display device including a light source module comprised of a plurality of light-emitting blocks, and the display quality of the display device may be enhanced. Each of the delaying parts (325, 525) in the embodiments in FIGS. 1, 5, and 8 may be implemented a programmable delay block, such as a digitally programmable delay block, comprising delay chains, for example a plurality of series-connected buffers, inverters, or latches, the outputs of which are multiplexed and selected by a digital input.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A driving device of a light source module, comprising:

a programmable delay block configured to delay a first reference clock by a phase compensation amount, the first clock signal being a clock signal applied to a display panel, the delayed first reference clock being a second reference clock input to a local-dimming driver, wherein the second reference clock is delayed by a propagation delay amount within the local-dimming driver;

a phase controller including the compensating delay block, configured to control the phase compensation amount to make the sum of the propagation delay amount and the phase compensation amount approximately equal to an integral multiple of the period of the first reference clock, and to generate the second reference clock by delaying the first reference clock by the phase compensation amount; and the local-dimming driver configured to driving a plurality of the light-emitting blocks by outputting driving signal synchronized and in-phase with the first reference clock based on receiving the second reference clock and a dimming level of each of the light-emitting blocks.

2. The driving device of the light source module of claim 1, further comprising a delay modeling part configured to model the propagation delay amount, wherein the delay modeling part receives the second reference clock and delays the second reference clock by the modeled propagation delay amount to generate a third reference clock.

3. The driving device of the light source module of claim 2, wherein the phase controller further comprises:

a phase comparator measuring the phase difference between the phase of the first reference clock and the phase of the third reference clock, the third reference clock being a second reference clock that has been delayed by the delay modeling part by the modeled propagation delay amount;

a calculation part controlling the compensating delay block to reset the delay compensation amount based on the phase difference wherein the compensating delay block delay the first reference clock by the reset phase compensation amount.

4. The driving device of the light source module of claim 3, wherein the delay modeling part includes a resistor and a capacitor.

5. The driving device of the light source module of claim 4, further including;

a generator generating an oscillation signal having a fixed frequency.

6. The driving device of the light source module of claim 3, wherein the delay modeling part performs modeling of the propagation delay amount by: using a first number k, the first number k being the number of periods of the oscillation signal within the propagation delay amount; and delaying the second reference clock by k periods of the oscillation signal.

7. The driving device of the light source module of claim 1, further including;

a dimming-level determination part configured to determine the dimming levels of each of the light-emitting blocks by analyzing a received image signal.

8. The driving device of the light source module of claim 7, wherein the delay modeling part counts a first number k1 of the number of cycles of the oscillation signal within the propagation delay amount.

9. The driving device of the light source module of claim 8, wherein the phase controller further comprises:

a calculation part counting a second number k2 corresponding to the period of the first reference clock, the second number k2 being the number of cycles of the oscillation signal within the period of the first reference clock;

a summing part outputting a third number calculated by subtracting the first number k1 from the second number k2; and wherein the compensating delay block receives the third number and delays the first reference clock by setting the phase compensation amount equal to the third number (k2−k1) of periods of the oscillation signal.

10. A light source apparatus comprising:

a light source module including a plurality of light-emitting blocks;

a delay modeling part performing modeling of the propagation delay amount, through a local-dimming driver outputting driving signals applied to the light-emitting blocks;

a phase controller configured to control a phase compensation amount to make the sum of the modeled propagation delay amount and the phase compensation amount equal to an integral multiple of the period of a first reference clock being a clock signal applied to a display panel, and to generate a second reference clock by delaying the first reference clock by the phase compensation amount; and the local-dimming driver configured to driving the light-emitting blocks in-phase with the first reference clock based on receiving the second reference clock and based on receiving a dimming level of the light-emitting blocks based on a image data signal.

11. The light source apparatus of claim 10, wherein the propagation delay amount has a fixed value.

12. The light source apparatus of claim 11, wherein the phase controller automatically controls the phase of the second reference clock based on the propagation delay amount and based on the frequency of the first reference clock.

13. A driving method of a light source module comprising:

modeling an amount of a propagation delay through a local-dimming driver that outputs driving signals applied to a plurality of light-emitting blocks based on receiving a clock signal applied to a display panel and based on receiving a dimming level of each of the light-emitting blocks based on image data;

delaying a first reference clock based on the clock signal by a phase compensation amount to generate a second reference clock, and controlling the phase compensation amount to make the sum of the modeled propagation delay amount plus the phase compensation amount equal to an integral multiple of the period of the first reference clock; and driving the light-emitting blocks in-phase with the clock signal by supplying the second reference clock and the dimming levels to the local-dimming driver, the second reference clock being the first reference clock delayed by the modeled phase compensation amount.

14. The driving method of a light source of claim 13, wherein delaying the phase of the first reference clock to generate the second reference clock is performed by resetting the phase compensation amount when the frequency of the first reference clock is changed.

15. The driving method of a light source of claim 14, wherein delaying the phase of the first reference clock further comprises:

measuring the phase difference between a third reference clock and the first reference clock, the third reference clock being the second reference clock having been delayed by the modeled propagation delay amount;

resetting the phase compensation amount based on summing the measured phase difference and the phase compensation amount; and delaying the first reference clock by the reset phase compensation amount to generate the second reference clock.

16. The driving method of a light source of claim 14, wherein modeling of the propagation delay amount further includes;

counting a first number k1 being the number of periods of an oscillation signal within the propagation delay amount.

17. The driving method of a light source of claim 16, wherein delaying the first reference clock further comprises:

counting a second number k2 being the number of periods of the oscillation signal within the period of the first reference clock;

outputting a third number (k2–k1) calculated by subtracting the first number k1 from the second number k2; and delaying the first reference clock by the phase compensation amount equal to the third number (k2–k1) of periods of the oscillation signal.

18. A display device, comprising:

a display panel for displaying an image, and being divided into a plurality of display blocks;

a light source module including a plurality of light-emitting blocks, for supplying light to the panel;

a control signal generator supplying a first reference clock to the panel and to the light source module, the first reference clock being a clock signal of a driving signal applied to the panel;

a delay modeling part performing modeling of a propagation delay amount through a local-dimming driver outputting driving signals applied to the light-emitting blocks;

a phase controller controlling a phase compensation amount to make the sum of the propagation delay amount plus the phase compensation amount equal to an integral multiple of a period of the first reference clock, and generating a second reference clock by delaying the first reference clock by the phase compensation amount; and the local-dimming driver configured to drive the light-emitting blocks tin phase with the first reference clock, based on receiving the second reference clock and receiving the dimming level of each of the light-emitting blocks based on image data.

19. The display device of claim 18, further comprising:

a timing controller applying the driving signal to the display panel, wherein the control signal generator and the phase controller are embodied at the timing controller.

20. The display device of claim 19, wherein the delay modeling part is included in the timing controller.

21. The display device of claim 20, wherein the timing controller includes a generator supplying an oscillation signal having a fixed-frequency.

* * * * *